US005577355A

United States Patent [19]

Leonelli

[11] Patent Number: 5,577,355

[45] Date of Patent: Nov. 26, 1996

[54] TWO PIECE WINDOW FRAME GENERATING FROM A SINGLE EXTRUSION

[75] Inventor: Louie Leonelli, Woodbridge, Canada

[73] Assignee: Pillar Plastics Limited, Woodbridge, Canada

[21] Appl. No.: 406,581

[22] Filed: Mar. 20, 1995

[51] Int. Cl.[6] ..... E06B 3/964

[52] U.S. Cl. ..... 52/204.62; 52/204.591; 52/204.597; 52/455

[58] Field of Search ..... 52/204.591, 204.595, 52/204.597, 455, 235, 204.62, 204.7, 204.72

[56] References Cited

U.S. PATENT DOCUMENTS

| | | | |
|---|---|---|---|
| 3,903,669 | 9/1975 | Pease, Jr. et al. | 52/455 |
| 4,021,967 | 5/1977 | Mulder et al. | 52/455 X |
| 4,407,100 | 10/1983 | Huelsekopf | 52/204.597 X |
| 4,750,310 | 6/1988 | Holcombe | 52/204.591 X |
| 5,040,347 | 8/1991 | Valvis | 52/204.591 |
| 5,133,168 | 7/1992 | Neilly et al. | 52/455 X |

FOREIGN PATENT DOCUMENTS

| | | | |
|---|---|---|---|
| 1167322 | 5/1984 | Canada | 52/204.62 |

*Primary Examiner*—Carl D. Friedman
*Assistant Examiner*—Yvonne Horton-Richardson

[57] ABSTRACT

A window frame comprises first and second window pane mounting frame pieces generated from a single extrusion with a bridge between the two frame pieces. The frame pieces are separated from one another at the bridge producing a bridge part on each of the frame pieces. The first frame piece has a side recess aligned with its bridge part to receive a fastener for mechanically securing the frame pieces back together with one another from opposite sides of the window pane through the bridge parts of the respective frame pieces.

5 Claims, 5 Drawing Sheets

TWO PIECE WINDOW FRAME GENERATING FROM A SINGLE EXTRUSION

FIELD OF THE INVENTION

The present invention relates to a window frame having first and second frame pieces to opposite sides of a window pane. The frame pieces are initially generated from a single extrusion separated from one another and then resecured to one another by a mechanical fastener.

BACKGROUND OF THE INVENTION

The art of framing a window can often be difficult and in many cases problems arise in fitting the frame around the window. Most conventional window frames are produced on mass for cost saving purposes as opposed to individually crafted frames which are substantially more expensive.

Vinyl and other thermoplastic frames are becoming ever more popular. Each of the frame sections, i.e. jambs, header and sill are cut from extruded lineals substantially longer than the length of each individual frame section. In cases where the window pane is fixed directly within the frame, each frame section has a two piece construction with the pieces being secured to one another from opposite sides of the pane. The opposing pieces of each frame section must be cut to an identical length, otherwise, the frame cannot be assembled. Furthermore, the pieces of each frame section need to be properly aligned with one another in order to receive securing screws at specific locations typically in the form or portholes provided in the frame material. As a further problem, these portholes may be stripped by the screw in which case the screw must be removed and the porthole rebuilt in order for the screw to properly secure the frame pieces.

Some of the window frames today are made from molded frame pieces which do provide accuracy of fit but which are very expensive principally due to the initial mold set up costs. Furthermore, molded frame pieces still suffer from screw stripping problems.

SUMMARY OF THE INVENTION

The present invention provides a window frame made from frame sections which are formed in manner to overcome the drawbacks noted above and made at a cost substantially less than that required for molded window frame sections. More particularly, a window frame section of the present invention comprises first and second frame pieces which are generated from a single extrusion and then separated at a bridge extending between the frame pieces. Each frame piece produced in this manner has its own bridge part. The first frame piece is provided with a side recess aligned with its bridge part to receive a fastener for mechanically securing the two frame pieces to one another from opposite sides of a window pane through the respective bridge parts of the first and second frame pieces.

Since the frame pieces come from a single extrusion, they are cut at the same time with one another ensuring identical length in the two frame pieces. Furthermore, only half as many cuts are required in comparison to conventional window frames because both sides of the frame section are cut at one time as opposed to having to cut each frame piece individually.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
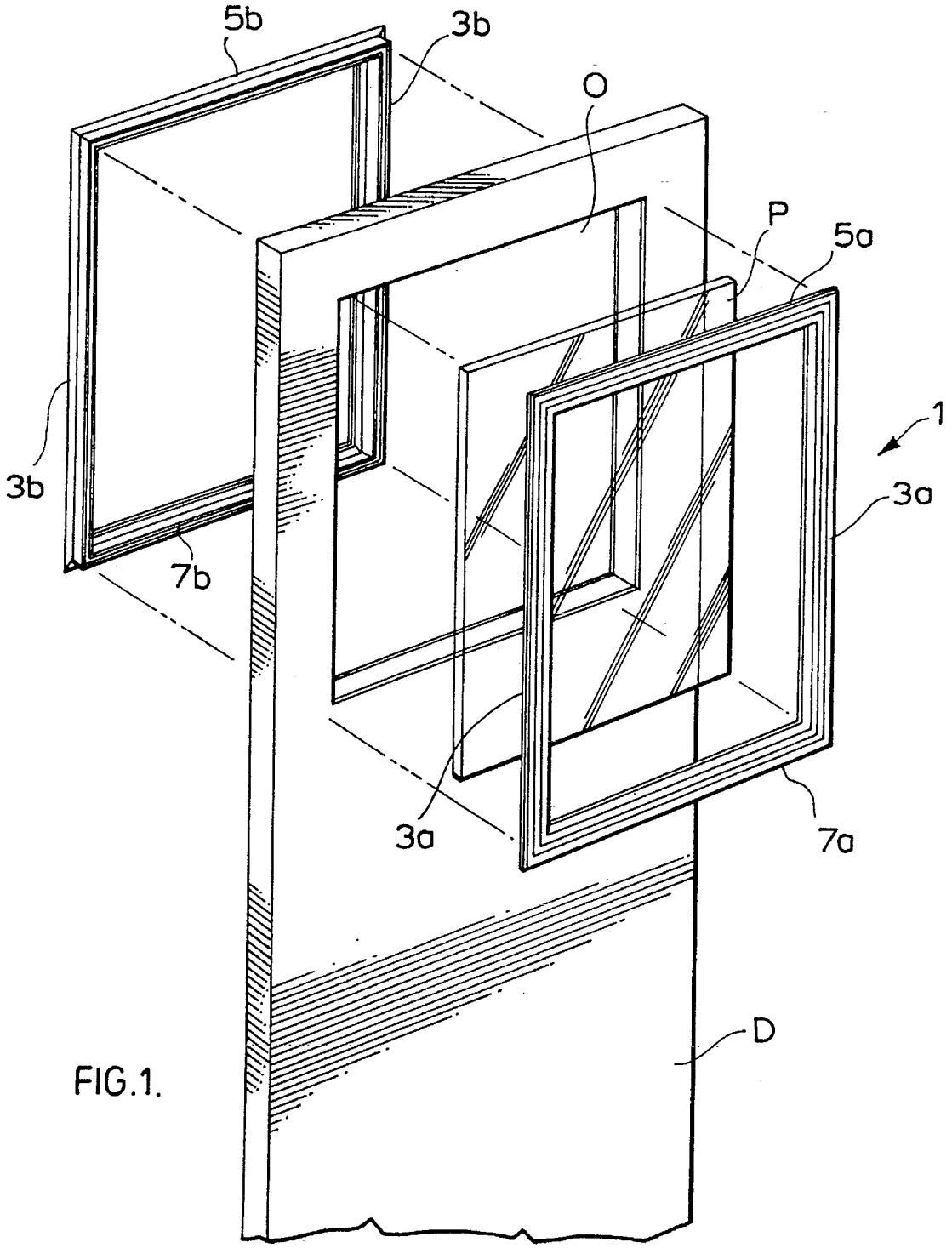
FIG. 1 is a perspective view of a door to be fitted with a window and window frame according to a preferred embodiment of the present invention.

FIG. 1 shows a window frame assembly generally indicated at 1 for fitting a glass panel P into the opening O of a door D. The panel once secured to the door is held in a fixed position by the frame system 1.

The frame system itself is formed by an upper header, side jambs and a lower sill. When the frame system is fully assembled, the header comprises opposing header pieces 5*a* and 5*b* secured to one another from opposite sides of the panel and the door, jamb pieces 3*a* and 3*b* secured to one another and sill pieces 7*a* and 7*b* also secured to one another from opposite sides of the panel and the door.

Figure 2:
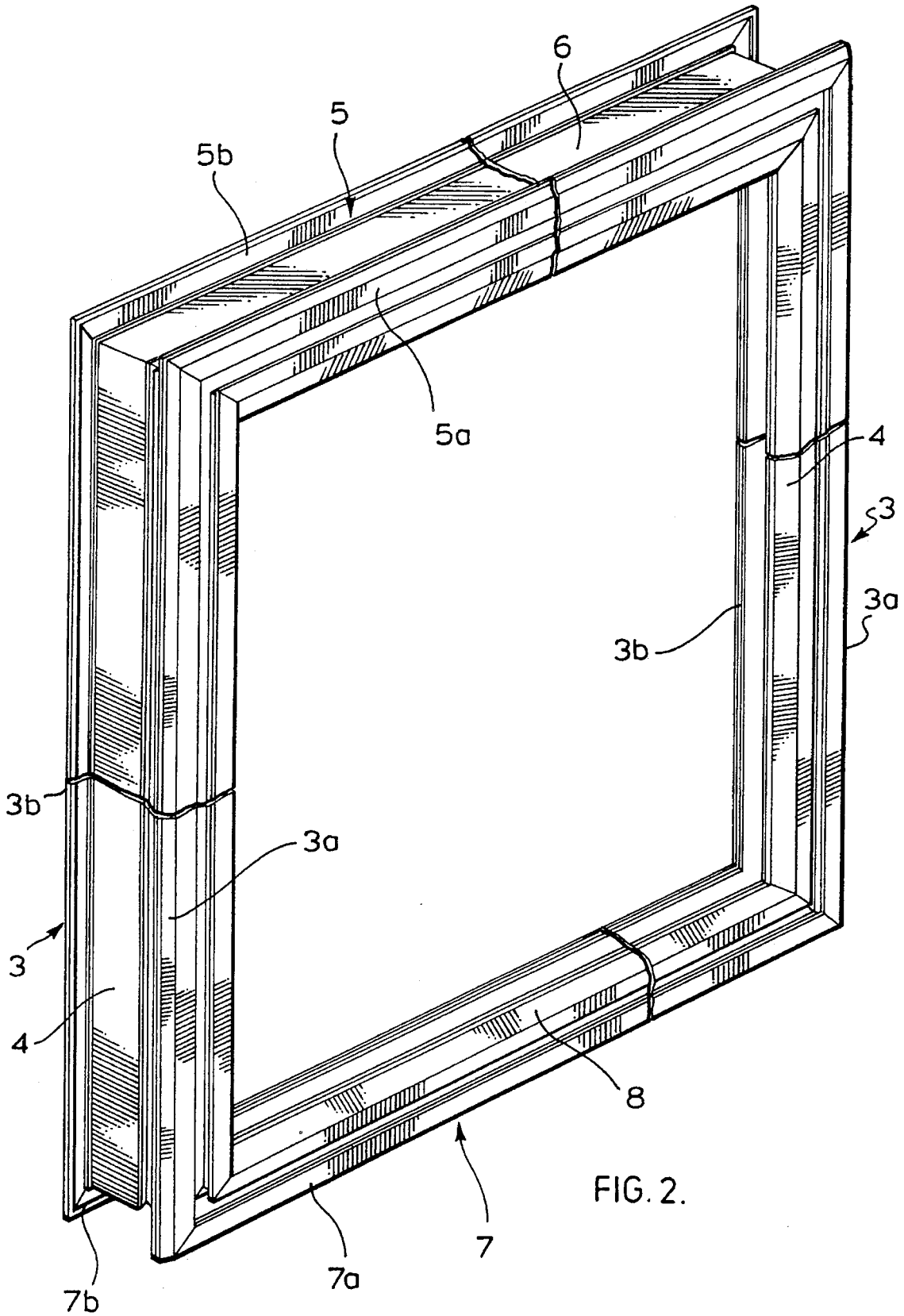
FIG. 2 is an enlarged perspective view of the window frame of FIG. 1 with the frame sections fitted to one another prior to dividing into opposing frame pieces.

Each of the individual frame sections, i.e the entire header, jambs and sill, are initially formed from a single unitary and preferably thermoplastic extrusion. FIG. 2 of the drawings shows the jamb 3, the sill 7 and the header 5 all having a unitary construction before they are separated into opposing frame pieces prepared for mounting to the panel and the door. As will be clearly seen in FIG. 2, the jamb pieces 3*a* and 3*b* are secured by a bridge 4 integral with both of the jamb pieces. The header 5 includes a bridge 6 securing the header pieces 5*a* and 5*b* and the sill 7 includes a bride 8 connecting the sill pieces 7*a* and 7*b*.

Just as a further explanation, each of the jambs 3 comes off of an extrusion line in the form shown in FIG. 2 where the jamb pieces 3*a* and 3*b* are integral with one another by means of the connection provided by bridge 4. The same is true of header 5 where the header pieces 5*a* and 5*b* are integral with one another through bridge 6 and the same is again true of sill 7 where the sill pieces 7*a* and 7*b* are integral with one another through bridge 8 shown in FIG. 3 of the drawings.

As a further preferred feature of the present invention, the header, the two jambs and the sill can all come from a single extrusion common to all of them.

Figure 3:
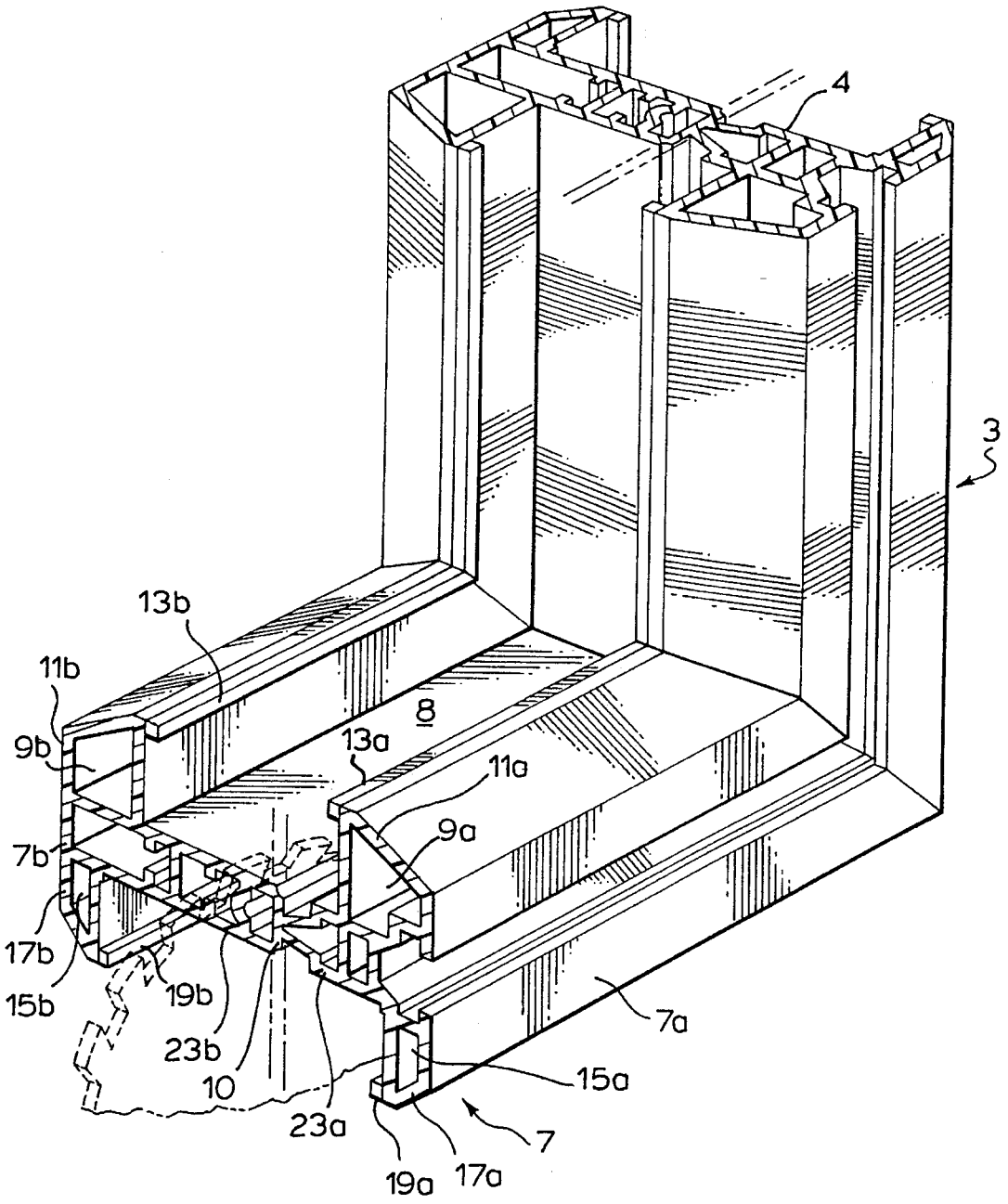
FIG. 3 is an enlarged perspective view of a corner region of two of the fitted frame sections of FIG. 2.

In order to fit the frame assembly to the window panel and the door, each of the individual frame sections is cut as again shown in FIG. 3 of the drawings to produce the separate jamb pieces 3*a* and 3*b*, the separate header pieces 5*a* and 5*b* and the separate sill pieces 7*a* and 7*b*. However, before doing this, the jambs, the header and the sill can all be provided with miter cuts while in their unitary construction as shown in FIG. 2 of the drawings. Here it should be noted that there is exact alignment of the frame sections because they come from a common lineal. Also to be noted is the fact that only a single cut is required at each end of each frame section and because the frame section is still in a unitary state comprising both frame pieces, only a single cut is required at each corner the frame assembly. This is to be contrasted to an arrangement in which the frame pieces to opposite sides of the window and door at each frame section must be cut individually making it difficult to ensure that the length of each of frame piece is identical to its opposing frame piece. In accordance with the present invention, this is not a problem because, as noted above, the entire frame section is cut while in the unitary state ensuring that both frame pieces are identical in length to one another.

Once the appropriate corner cuts have been made to each of the frame sections and while they all remain in a unitary state, the frame sections are secured to one another either mechanically or by welding the meeting ends of the frame sections.

After the overall frame has been assembled as shown in FIG. 2, the frame pieces, i.e. the pieces which go to opposite sides of the window panel and the door are separated from one another to produce jamb pieces 3*a* and 3*b*, header pieces 5*a* and 5*b* and sill pieces 7*a* and 7*b* shown in FIG. 1 of the drawings. FIG. 3 of the drawings shows that the frame pieces are separated from one another at the bridge which secures them during the initial extrusion process.

More particularly, FIG. 3 shows the sill 7 being divided into sill pieces 7*a* and 7*b*. This is done through the use of a cutting tool which cuts through the bridge 8 securing sill pieces 7*a* and 7*b* to one another. The cutting tool will continue to run around one jamb, the header and then the other jamb to divide the overall frame into the opposite side pieces.

After the frame has been cut, each frame piece ends up with its own bridge part. FIG. 3 shows sill piece 7*a* as having a bridge part 23*a* and sill piece 7*b* as having a bridge part 23*b*. The cutting tool or saw shown in FIG. 3 cuts into bridge 8 between the two bridge parts 23*a* and 23*b*.

Figure 4:
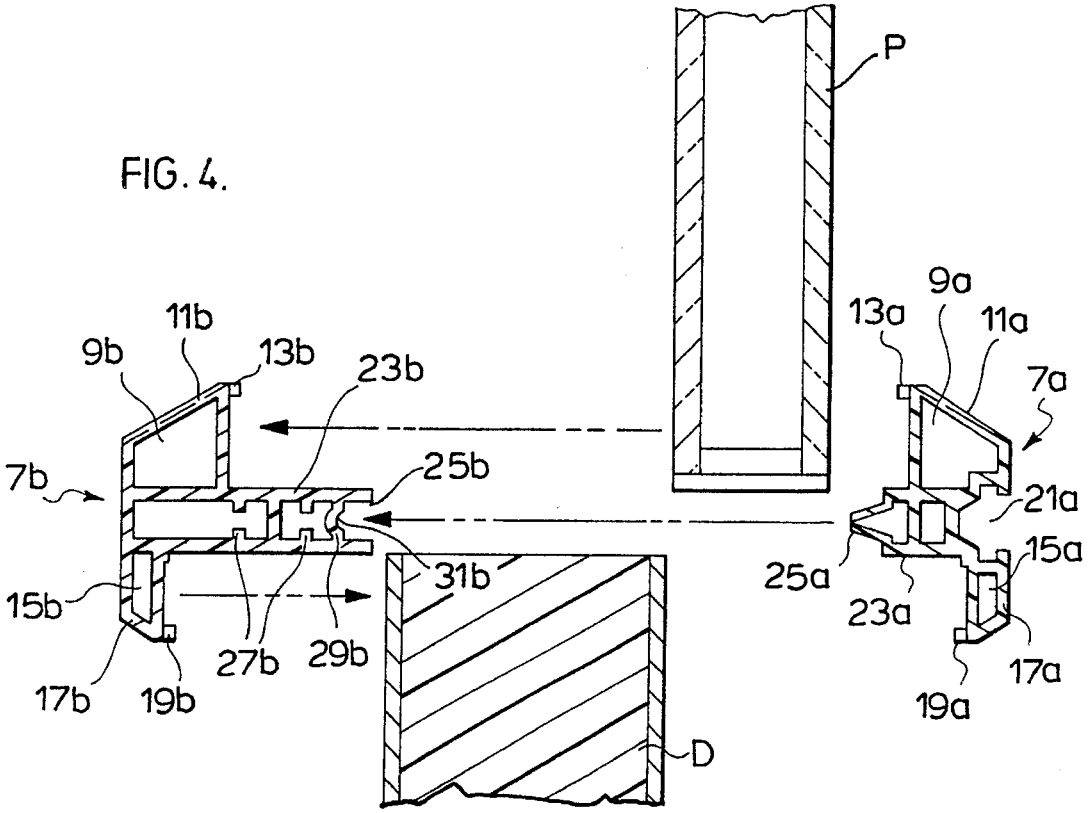
FIG. 4 is a sectional view showing the fitting of the sill frame section of the frame of FIG. 1 to the door and the window pane.

The separation of the two sill pieces 7*a* and 7*b* is best shown in reference to FIG. 4 of the drawings. Here it will be seen that bridge part 23*a* terminates with a male end 25*a* and bridge part 23*b* terminates with a female end 25*b*. It should also be noted that the male end of bridge part 23*a* has a taper which acts as a guide for inserting it into the female end of bridge part 23*b*. Also, bridge part 23*b* is longer than bridge part 23*a* which eases the fitting of the two mating bridge parts with one another as described later in detail.

FIG. 4 also shows that bridge part 23*b* is provided with internal ribs such as ribs 27*b* which extend part way across the otherwise hollow interior of bridge part 23*b*. A further rib 29*b* which completely spans bridge part 23*b* at its open end is provided with a central recess 31*b*. This central recess acts as a screw guide as will also be described later in greater detail.

Each of the sill pieces 7*a* and 7*b* comprises a window fitting portion and a door or other window support fitting portion. In particular, sill piece 7*a* includes an upper window fitting portion 9*a* and a lower door fitting portion 15*a*. Sill piece 7*b* includes an upper window fitting portion 9*b* and a lower door fitting portion 15*b*.

According to a preferred embodiment of the present invention, the sill as well as the other frame sections are as noted above, extruded from a thermoplastics and preferably vinyl material. The extrusion is actually a coextrusion of a relatively rigid and a softer more flexible plastic material. The rigid material forms the main body of each of the window and door fitting portions as indicated at 11*a* and 17*a* with respect to frame piece 7*a* and as indicated by 11*b* and 17*b* of frame piece 7*b*. Edge strips 13*a* and 19*a* of a softer material are co-extruded on frame piece 7*a* while frame piece 7*b* is provided with softer coextruded edge strips 13*b* and 19*b*. These edge strips provide a positive leak resistant grip on the window panel and the door as shown for example in FIG. 6 of the drawings.

As a final construction feature, frame piece 7*a* as well as the other frame pieces with which it is mated on the same side of the overall frame, is provided with a recess 21*a* which extends the full length of frame piece 7*a*. This recess aligns with bridge part 23*a*.

In order to install the window in the door, the one half of the frame is placed on one side of the door and the other half of the frame is placed on the other side of the door with the window panel positioned between the two frame halves as shown in FIG. 1 of the drawings. The preferred method of assembly comprises fitting the outer frame half formed by frame pieces 3*b*, 5*b* and 7*b* into the door opening, placing the panel against the fitted frame half and then pushing the other inner frame half comprising frame pieces 3*a*, 5*a* and 7*a* against the opposite side of the panel. The bridge parts on the one half of the frame align with the bridge parts on the other half of the frame and a series of mechanical fasteners such as screw 37 are threaded into the aligned bridge parts through the recesses on the inner side of the frame, i.e. screw 37 as well as a number of other screws are fitted into recess 21*a* of sill piece 7*a*. Further screws are fitted into the recesses provided in the jambs and the header as well.

As earlier described, bridge part 23*b* is longer than bridge part 23*a* so that the former bridge part extends more than half way across the door and nearly the full distance across the window panel which, in combination with the tapered shape of end surface 25*a*, makes it very easy to mate the two bridge parts with one another. Furthermore, the recess 31*b* centrally of rib 29*b* in bridge part 23*b* provides a very effective guide or lead in for the end of each of the screws 37 to ensure that the screws pass generally centrally through the bridge which becomes reconnected via the mechanical fasteners. In addition, the internal ribbing of bridge part 23*b* provides a natural grip surface for the threads on the screws. Furthermore, since some of the ribs extend only part way across bridge part 23*b* and because both bridge parts have a generally hollow construction, the screws 37 can be threaded into the aligned bridge parts with relatively little difficulty. However, the internal ribbing provides more than sufficient grip to positively pull and hold the overall assembly together.

A further benefit of the present invention is provided by virtue of the fact that if one or more of the screws does strip the material in the bridge, each screw can quickly and easily be removed from the stripped location and replaced at any other desired location without having to refurbish the frame. This benefit is provided as a result of the continuous nature of the screw receiving recess along each of the frame pieces on the one side of the frame and is to be contrasted to conventional arrangements where specific locations are provided for screw ports which as described above are very difficult to work with if they become stripped. Furthermore, they can be difficult to align from one side of the frame to the other which is not a problem when working with a continuous opening as found in the present invention.

In order to complete the overall assembly, a recess covering strip such as for example, strip 33 is used to cover recess 21*a*. In the embodiment shown, strip 33 includes small pronged legs 35 which snap fit into the recess so that none of the fastening screws can be seen giving the overall assembly a neat and completed appearance.

Note that although the fastener receiving recess has been located in the drawings on the inside frame pieces, it could also be provided on the outside pieces of the frame.

Figure 6:
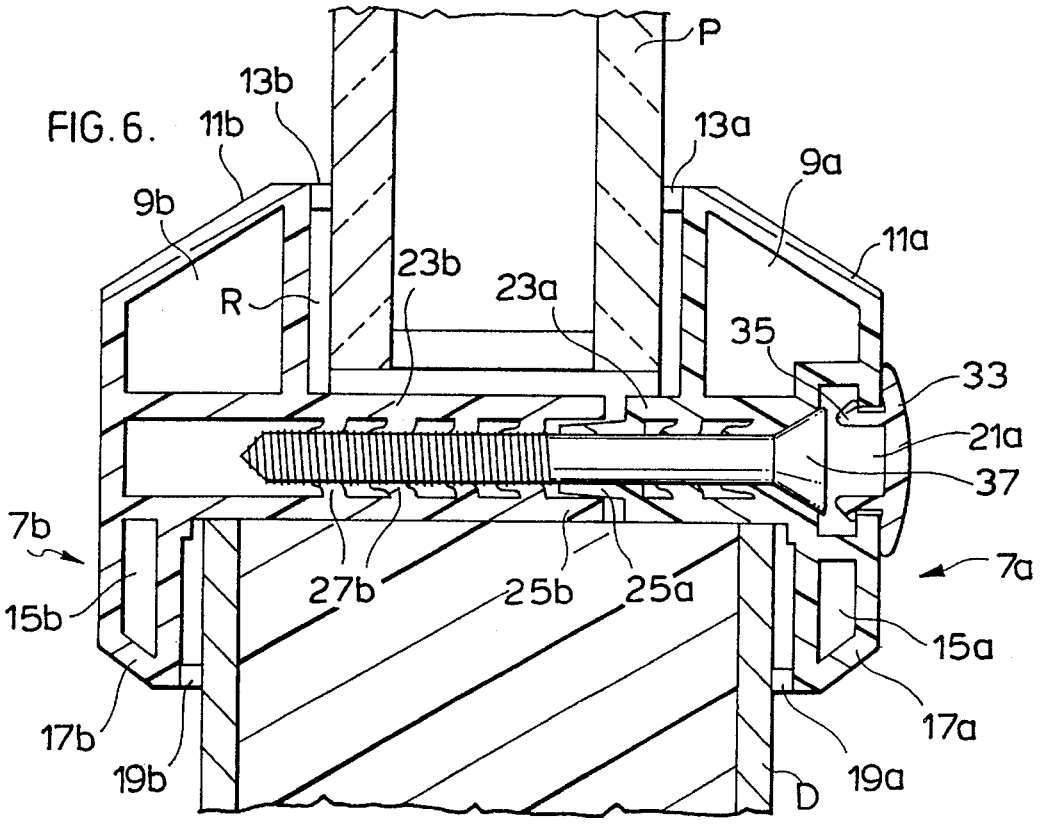
FIG. 6 is an end view showing the frame section of FIG. 5 when finally assembled.
Figure 5:
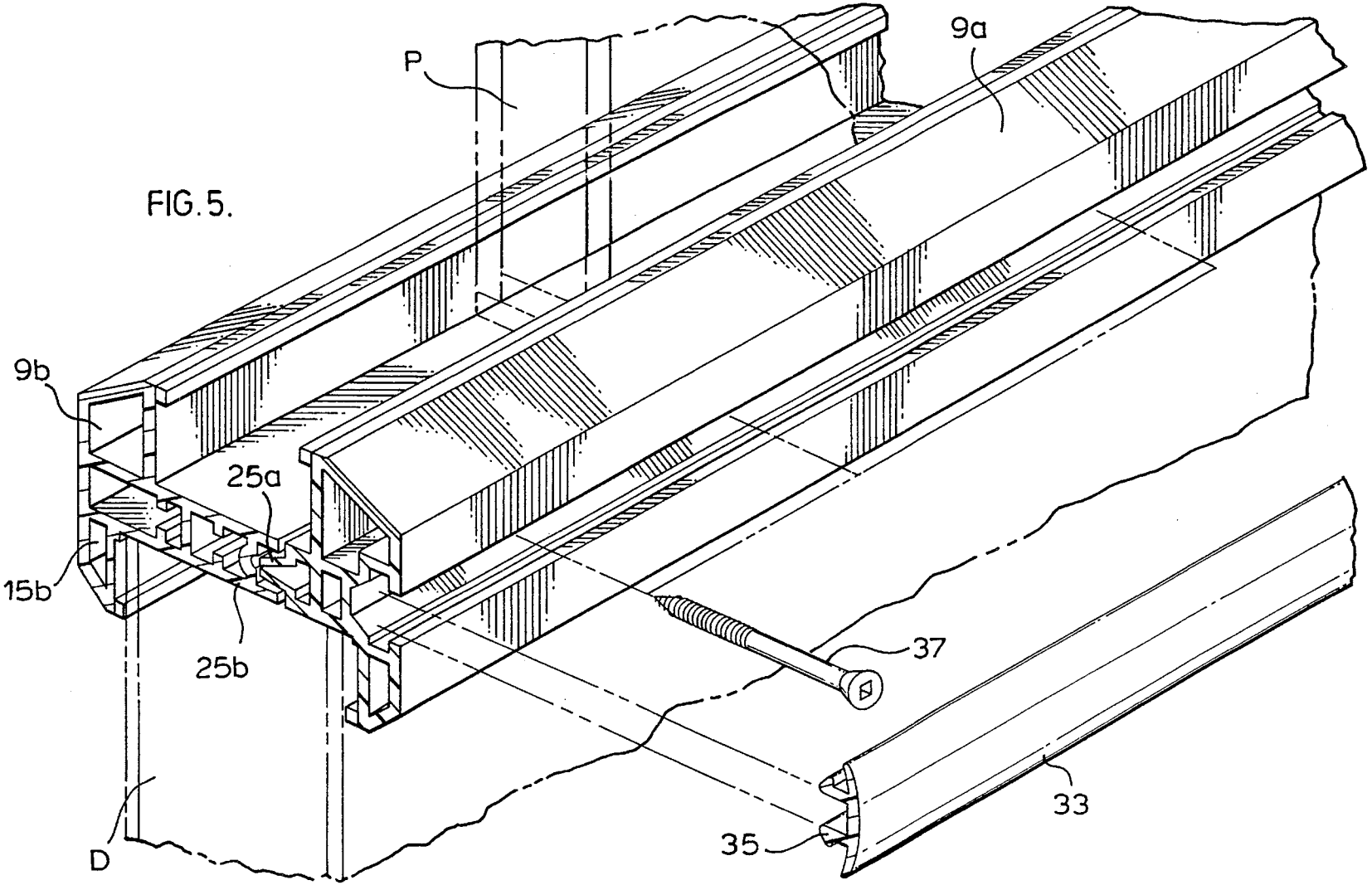
FIG. 5 is a perspective view showing the final steps of assembly of the frame section of FIG. 4.

Although it may not be required, additional sealants such as a double sided sticky tape or the like can be fitted into any one of the recesses such as recess R shown in FIG. 6 created by the natural gap provided between any one of the soft edge strips and its respective more rigid main body part of the frame. Also sealing material can be provided in the-female bridge part end to ensure that the mechanically secured bridge is completely leak proof.

Although various preferred embodiments of the present invention have been described in detail, it will be appreciated by those skilled in the art, that variations may be made without departing from the spirit of the invention or the scope of the appended claims.

The embodiments of the invention in which an exclusive property or privilege is claimed are defined as follows:

1. A window frame comprising first and second frame pieces having first and second bridge parts generated from a single extrusion and then separated from one another between said bridge parts and said first frame piece having a side recess aligned with said first bridge part to receive a fastener for mechanically securing said frame pieces to one another from opposite sides of a window pane through said bridge parts and said bridge parts having male and female end surfaces which fit with one another in forming said window frame.

2. A window frame as claimed in claim 1, wherein said male end surface has a tapered configuration providing a guide into said female end surface when said bridge parts are mechanically secured to one another.

3. A window frame as claimed in claim 1 wherein said side recess extends at least substantially full length of said first frame piece and includes an elongated snap cover over said recess.

4. A window frame comprising first and second frame pieces having first and second bridge parts generated from a single extrusion and then separated from one another between said bridge parts and said first frame piece having a side recess aligned with said first bridge part to receive a fastener for mechanically securing said frame pieces to one another from opposite sides of a window pane through said bridge parts and wherein said second bridge part has a generally hollow construction provided with internal ribs for engaging the fastener.

5. A window frame as claimed in claim 4, wherein one of said ribs faces outwardly of and spans said second bridge part and includes a central recess providing a fastener guide into said second bridge part.

* * * * *